US011549324B2

(12) United States Patent
AlShehri et al.

(10) Patent No.: US 11,549,324 B2
(45) Date of Patent: Jan. 10, 2023

(54) PUMPING STINGER OVERSHOT

(71) Applicant: SAUDI ARABIAN OIL COMPANY, Dhahran (SA)

(72) Inventors: Abdullah N. AlShehri, Khobar (SA); Nadeer A. AlZayer, Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 172 days.

(21) Appl. No.: 16/999,532

(22) Filed: Aug. 21, 2020

(65) Prior Publication Data

US 2022/0056777 A1 Feb. 24, 2022

(51) Int. Cl.
*E21B 31/18* (2006.01)

(52) U.S. Cl.
CPC ..... *E21B 31/18* (2013.01)

(58) Field of Classification Search
CPC ..... E21B 31/18; E21B 31/20
See application file for complete search history.

(56) References Cited

U.S. PATENT DOCUMENTS 1,795,322 A * 3/1931 Triplett ..... E21B 31/18 294/86.15
2,232,949 A * 2/1941 Jones ..... E21B 31/18 294/86.2
2,577,994 A 12/1951 Bendeler et al.
2,935,130 A 5/1960 Moore
3,417,822 A 12/1968 Howell
3,727,967 A * 4/1973 Anastasiu ..... E21B 31/18 294/102.1
3,809,161 A 5/1974 Carothers
3,944,273 A * 3/1976 Ahistone ..... E21B 33/043 294/86.18
5,085,479 A 2/1992 Taylor
5,149,163 A * 9/1992 Pruitt ..... E21B 31/18 294/86.32
2009/0017881 A1 7/2009 Cenac et al.
(Continued)

FOREIGN PATENT DOCUMENTS

AU 2009244318 B2 10/2012
EP 0418057 A1 3/1991
(Continued)

OTHER PUBLICATIONS

International Search Report and Written Opinion issued in Application No. PCT/US2021/046966, dated Nov. 19, 2021 (12 pages).

*Primary Examiner* — Christopher J Sebesta
(74) *Attorney, Agent, or Firm* — Osha Bergman Watanabe & Burton LLP

(57) ABSTRACT

An overshot apparatus includes a tubular housing and a grapple disposed within a bore of the tubular housing. The grapple has a central opening to receive a fish and is operable to grip an outer diameter of the fish. A stinger is supported in the bore by an adapter attached to an upper end of the tubular housing. The stinger is positioned to be inserted into the fish received in the central opening of the grapple. A packing element is positioned on an external surface of the stinger to engage an inner diameter of the fish when the stinger is inserted into the fish and the fish is received within the central opening of the grapple. The adapter and stinger have conduits for passage of fluid into the fish.

20 Claims, 6 Drawing Sheets

(56) References Cited

U.S. PATENT DOCUMENTS

| | | | | |
|---|---|---|---|---|
| 2015/0240571 | A1* | 8/2015 | Bowles | E21B 19/16<br>285/351 |
| 2018/0003034 | A1* | 1/2018 | Roth | E21B 43/128 |

FOREIGN PATENT DOCUMENTS

| | | | |
|---|---|---|---|
| WO | 2000061909 | A1 | 10/2000 |
| WO | 2015077517 | A1 | 5/2015 |

* cited by examiner

PUMPING STINGER OVERSHOT

BACKGROUND

In the oilfield, the term "fish" is used to describe any item left in a wellbore. In some cases, fish may specifically refer to any item left in the wellbore that impedes further operations in the wellbore. During drilling operations, fish could be a drill string or parts of a drill string, such as a drill pipe, drill collar, drill bit, logging tool, and other such items. The fish may be a result of the drill string experiencing mechanical sticking or mechanical failure during a drilling operation.

When there is a fish in a wellbore, a fishing operation may be carried out to remove the fish from the wellbore. One type of fishing tool that may be used to retrieve tubular fish, such as a pipe, is an overshot. The overshot includes a slip mechanism to engage an outer diameter of the fish. After the overshot engages the fish, fluid may be circulated through the fish in order to assist in releasing the fish from a stuck position. To ensure that the fluid pumped down the overshot goes into the fish, as opposed to around the fish, a packer seal may be included in the overshot to seal around the fish. The sealing is typically on the cross-sectional area of the fish top where the sealing is directly subjected to the fluid flowing into the fish, making the packer seal vulnerable to erosion by the fluid flow or damage by aggressive fluids such as acids. The pressure and flow rate at which fluid can be pumped into the fish typically have to be limited to prevent or minimize damage to the packer seal. In some cases, the allowable fluid pressure and flow rate may be too low to be effective in releasing the fish from the stuck position.

SUMMARY

In a first summary example, an apparatus includes a tubular housing having an inner surface defining a bore. A grapple is disposed within the bore and movably engaged with a profile on the inner surface of the tubular housing. The grapple has a central opening to receive a fish and is operable to grip an outer diameter of the fish. An adapter having a first conduit is attached to an upper end of the tubular housing. A stinger is disposed within the bore and attached to the adapter. The stinger has a second conduit that is fluidly connected to the first conduit of the adapter. The stinger is positioned to be inserted into the fish received in the central opening of the grapple. A packing element is positioned on an external surface of the stinger to engage an inner diameter of the fish when the stinger is inserted into the fish and the fish is received within the central opening of the grapple.

The adapter may include a first connection for the stinger and a second connection for a work string. The first conduit may extend between the first connection and the second connection. The first and second connections may include box threads of opposite hands.

A grapple control may be disposed within the bore of the tubular housing and engaged with the inner surface of the tubular housing. The grapple control may have a key inserted into a slot in the grapple. The grapple control has a central opening for passage of the fish into the central opening of the grapple. The grapple control may include mill teeth positioned to mill around the fish as the fish passes through the central opening of the grapple control. A guide may be attached to a lower end of the tubular housing. The guide may have a central opening for passage of the fish into the central openings of the grapple control and the grapple.

The packing element may be replaceably mounted on the external surface of the stinger. The packing element may be disposed in a slot formed on the external surface of the stinger.

In a second summary example, a system includes an overshot apparatus. The overshot apparatus includes a tubular housing having an inner surface defining a bore and a grapple disposed within the bore and movably engaged with a profile on the inner surface of the tubular housing. The grapple has a central opening to receive a fish and is operable to grip an outer diameter of the fish. The overshot apparatus includes an adapter attached to an upper end of the housing. The adapter has a first conduit. The overshot apparatus includes a stinger disposed within the bore and attached to the adapter. The stinger has a second conduit fluidly connected to the first conduit in the adapter. The stinger is positioned within the bore to be inserted into the fish received in the central opening of the grapple. The overshot apparatus includes a packing element positioned on an external surface of the stinger to engage an inner diameter of the fish when the stinger is inserted into the fish and the fish is received within the central opening of the grapple. The system includes a work string coupled to the adapter of the overshot apparatus. The work string has a third conduit fluidly connected to the first conduit in the adapter.

The overshot apparatus may be movably disposed in a wellbore on an end of the work string. The system may include a pump that is arranged to supply a fluid into the work string. The system may include a mechanism to rotate the work string.

The adapter may include a first connection that engages the stinger and a second connection that engages the work string. The first conduit may extend between the first connection and the second connection. The first and second connections may include box threads of opposite hands.

The overshot apparatus may include a grapple control disposed within the bore and engaged with the inner surface of the tubular housing. The grapple control may have a key inserted into a slot in the grapple. The grapple control has a central opening for passage of the fish to the central opening of the grapple. The grapple control may include mill teeth positioned to mill around the fish as the fish passes through the central opening of the grapple control.

The overshot apparatus may include a guide attached to a lower end of the tubular housing. The guide has a central opening for passage of the fish into the central openings of the grapple control and grapple.

In a third summary example, a method includes running an overshot apparatus into a wellbore on an end of a work string. The method includes receiving a fish within a central opening of a grapple of the overshot apparatus and inserting a stinger of the overshot apparatus into the fish while the fish is received within the central opening of the grapple. The method includes engaging a packing element carried on an outer diameter of the stinger with an inner diameter of the fish to form a seal between the stinger and the fish. The method includes actuating the grapple to grip an outer diameter of the fish.

The method may include pumping a fluid into the work string to establish circulation of the fluid to a bottom of the fish. The method may include detecting the seal between the stinger and the fish prior to pumping the fluid into the work string to establish circulation of the fluid to the bottom of the fish.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
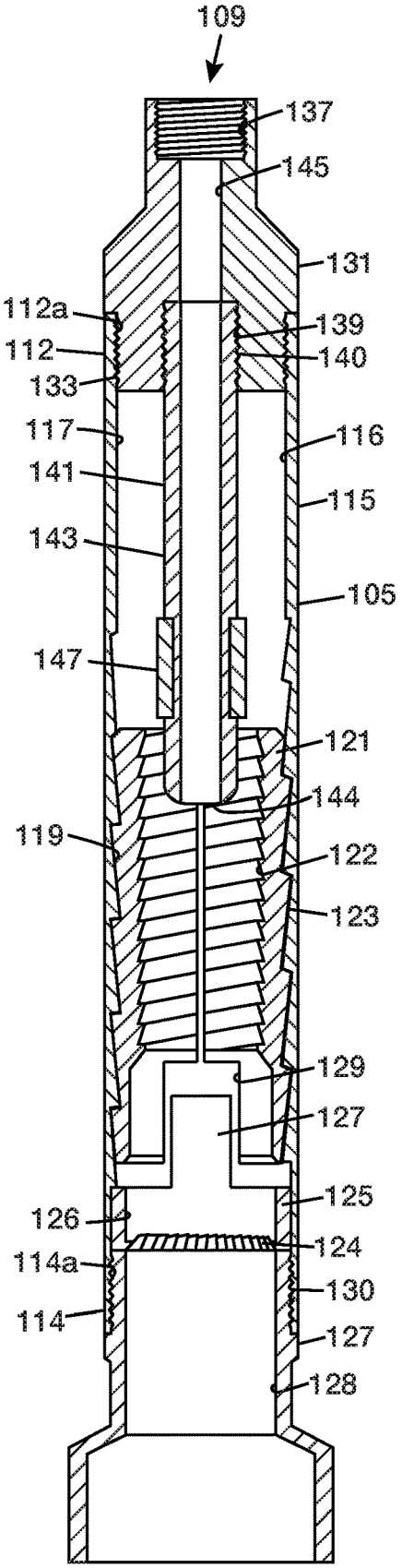
FIG. 1 is a cross-section of an overshot apparatus.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

FIG. 1 shows one illustrative implementation of an overshot apparatus 109 including a bowl (or tubular housing) 115 having an upper end 112 including a box thread 112*a* and a lower end 114 including a box thread 114*a*. Box threads are threads located on a surface defining a bore. Ends 112, 114 with box threads may also be referred to as box connections. Bowl 115 has an inner surface 116 defining a bore 117. A tapered threaded section 119 is formed on inner surface 116. A grapple 121 is disposed in tapered threaded section 119 and includes a tapered threaded surface 123 to conform to tapered threaded section 119. Grapple 121 is movable vertically within bore 117 and relative to bowl 115. Grapple 121 includes a central opening that is axially aligned with bore 117 to receive a fish. Grapple 121 may include wickers 122 around the central opening to grip an outer diameter of a fish. Grapple 121 is shown as a basket grapple, i.e., a slotted expandable cylinder. In an alternative implementation, grapple 121 may be a spiral grapple or other type of gripping mechanism that may be used in an overshot. Moreover, grapple 121 is not limited to the particular example of basket grapple shown in FIG. 1.

A guide 127 is attached to lower end 114 of bowl 115. In one example, guide 127 includes a pin thread 130 that engages box thread 114*a*. Guide 127 has a central opening 128 that is aligned with bore 117. Central opening 128 is sized to fit over a certain range of fish diameters. Guide 127 guides a fish into grapple 121 and may also prevent a fish that is too big from entering into grapple 121. Guide 127 may be an oversized guide that is used when the hole is larger than the fish size and the overshot can pass alongside the fish. The size of oversize guide 127 will be selected based on the size of hole in which the fish is located. For example, if the hole has a size (or diameter) of 22 inches, an oversize guide having a size of 20 inches can be run with a bowl having a size of 13-⅝ inches. A grapple control 125 is arranged within bore 117 and between grapple 121 and guide 127. Grapple control 125 may be abutted against a shoulder formed by tapered threaded section 119. Grapple control 125 includes a key 127 that fits into a slot 129 in grapple 121. Key 127 in slot 129 allows grapple control 125 to transmit torque from bowl 115 to grapple 121 and guides vertical motion of grapple 121 within bore 117. In some cases, a bottom end of grapple control 125 may include mill teeth 124. Grapple control 125 has a central opening 126 to allow a fish to enter grapple 121 from below guide 127. Grapple control 125 may be used to clear away debris from around the fish as the fish enters into grapple 121.

A top sub (or adapter) 131 is attached to upper end 112 of bowl 115. In one example, top sub 131 includes a pin thread 133 that engages box thread 114*a* in bowl 115. Top sub 131 includes a box thread 137 at an upper end for connection of overshot apparatus 109 to a work string or to an adapter that can be connected to a work string. Top sub 131 includes a box thread 139 at a lower end that is disposed within bore 117. A tubular body (or stinger) 141 is disposed inside bore 117 and includes a pin thread 140 that engages box thread 139 on top sub 131. Box threads 137, 139 on top sub may have opposite hands. For example, box thread 137 may be a right-handed thread, while box thread 139 is a left-handed thread. Because the two threads are opposite to each other, neither of the threads will become loose while rotating a work string with the overshot apparatus engaged with the fish. In addition, top sub 131 includes a conduit 145 that extends between box threads 137, 139.

Stinger 141 has a diameter that is smaller than that of a fish to be caught by overshot apparatus 109. Stinger 141 is positioned within bore 117 so that it can be inserted into a fish that is received within grapple. In one example, this positioning may mean that stinger 141 is axially aligned with the central opening of grapple 121, or with the axial axis of bore 117, and that lower end portion of stinger 141 is disposed within the central opening of grapple 121. This may also be described as the lower end portion of stinger 141 being concentric with grapple 121. The length of stinger 141 may be a design variable. For example, stinger 141 may extend further into grapple 121 and have a shorter length than shown in FIG. 1. Stinger 141 is a tubular body having an internal conduit 143 for passage of fluid. When stinger 141 is attached to top sub 131, conduit 143 will be fluidly connected to conduit 145 in top sub 131. When a work string is coupled to top sub 131 via box thread 137, the conduit of the work string will also be fluidly connected to conduits 143, 145, which would allow fluid to flow from the work string into stinger 141. Stinger 141 has an end port 144 for exit of the fluid from conduit 143. If stinger 141 is inside a fish, the fluid at end port 144 will be discharged into the fish.

In one implementation, stinger 141 carries an external packing element 147, which may have a ring shape in order to form a circumferential seal. When stinger 141 is inside a fish that is within grapple 121, external packing element 147 engages the inside diameter of the fish, forming a seal between the stinger and the fish. The external packing element 147 is offset by some distance from the stinger end, i.e., the end where end port 144 is located. The location of external packing element 147 will allow for some cushion between the stinger end and the packing element. While packing element 147 provides a seal between stinger 141 and the fish, this cushion will protect packing element 147 from erosion by the fluid flow through the stinger into the fish and from damage by aggressive fluids such as acids. With the seal formed between the stinger and fish by external packing element 147, fluid that is discharged into the fish from end port 144 of stinger 141 will flow to the bottom of the fish.

External packing element 147 may be retained on the outer diameter of stinger 141 using any suitable method. For example, a slot may be formed on the outer diameter of stinger to hold external packing element 147. In some cases, bonding may be used to secure external packing element 147 to stinger 141. In some cases, fasteners or other removable means may be used to secure external packing element 147 to stinger 141 so that an appropriate size of external packing element can be selected for the size of fish to be caught with the overshot apparatus. External packing element 147 may be made of elastic materials such as rubber or other packing seal elements known in the art. Preferably, packing element 147 is designed to withstand a pressure up to 4,000 psi. More preferably, packing element 147 is designed to withstand a pressure up to 5,000 psi.

Figure 2:
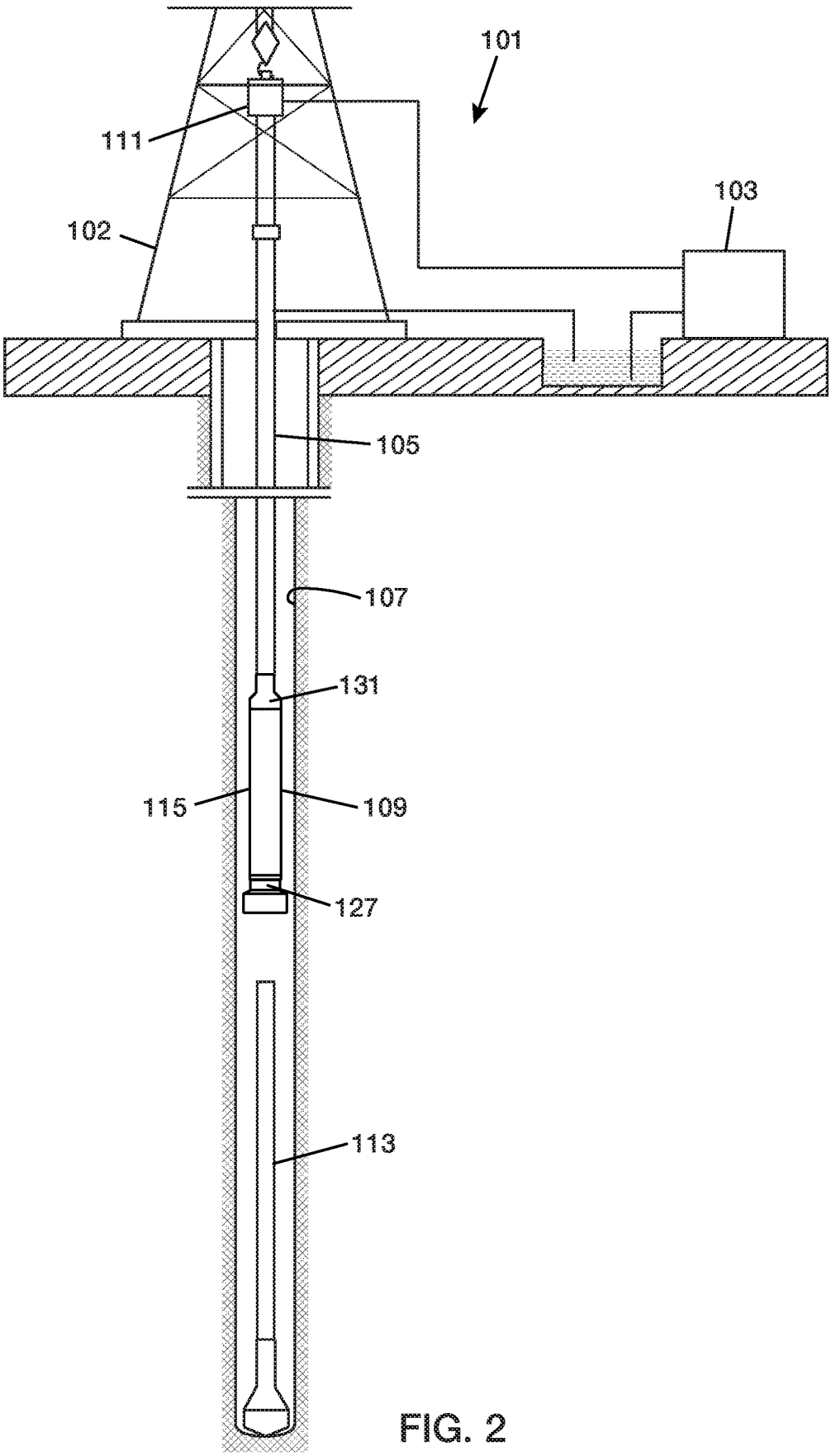
FIG. 2 is a schematic diagram of a system for performing a fishing operation in a wellbore.

FIG. 2 shows a system 101 including a pump 103 at a surface, a work string 105 extending from a top drive 111 supported by a derrick 102 at the surface into a wellbore 107, and overshot apparatus 109 (in FIG. 1) coupled to a lower end of work string 105 and disposed in wellbore 107. Work string 105 may include one or more drill pipes to provide a conduit through which freeing fluid can be transferred from pump 103 into overshot apparatus 109. The freeing fluid may be any conventionally known drilling fluid, such as water-based muds, oil-based muds, and gaseous fluid, and may include additives to facilitate freeing of a fish from a stuck position. Top drive 111 may be operated to rotate work string 105 and includes flow passages through which fluid from pump 103 can be provided to work string 105. Instead of a top drive, a rotary table and a rotary swivel may be used to rotate work string 105 and transfer fluid to work string 105 as is known in the art. Since overshot apparatus 109 is coupled to work string 105, overshot apparatus 109 will rotate with work string 105. Although not shown, work string 105 may include other fishing equipment, such as jars.

Figure 3:
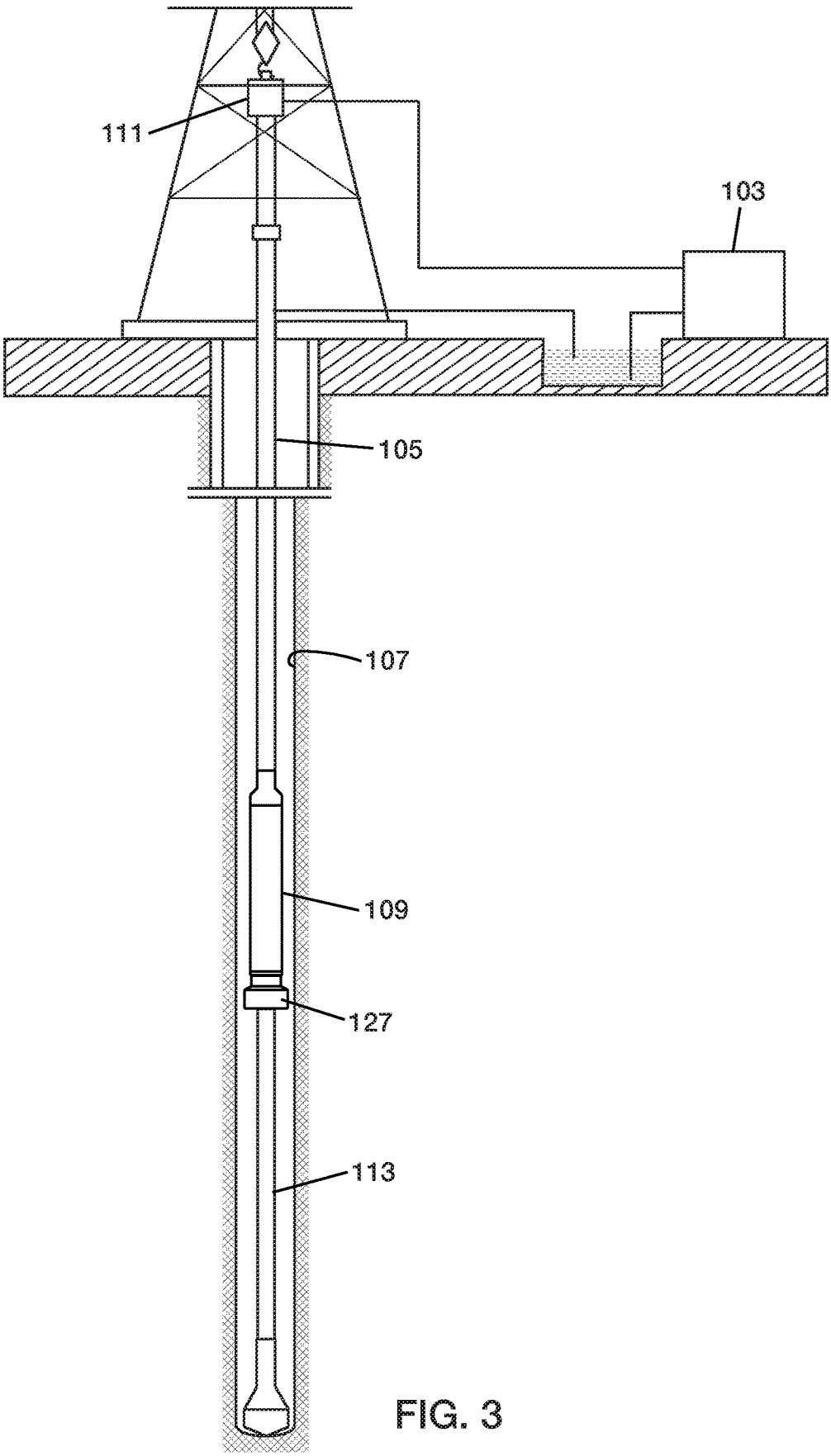
FIG. 3 shows the system of FIG. 2 with an overshot apparatus fitted over a fish in the wellbore.
Figure 4:
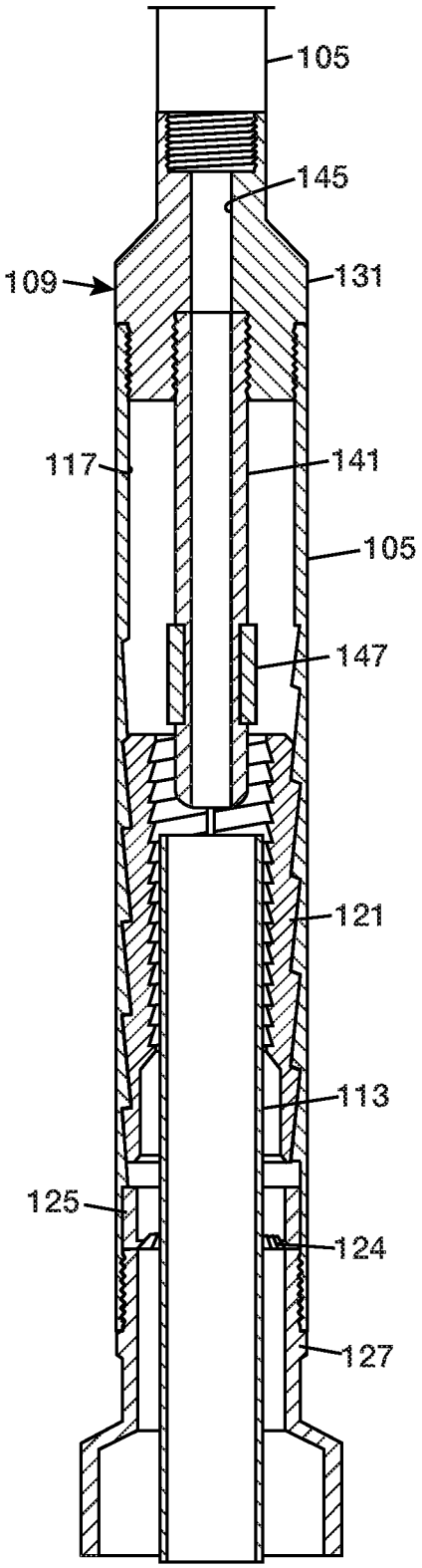
FIG. 4 shows a fish received inside a grapple of an overshot apparatus.
Figure 5:
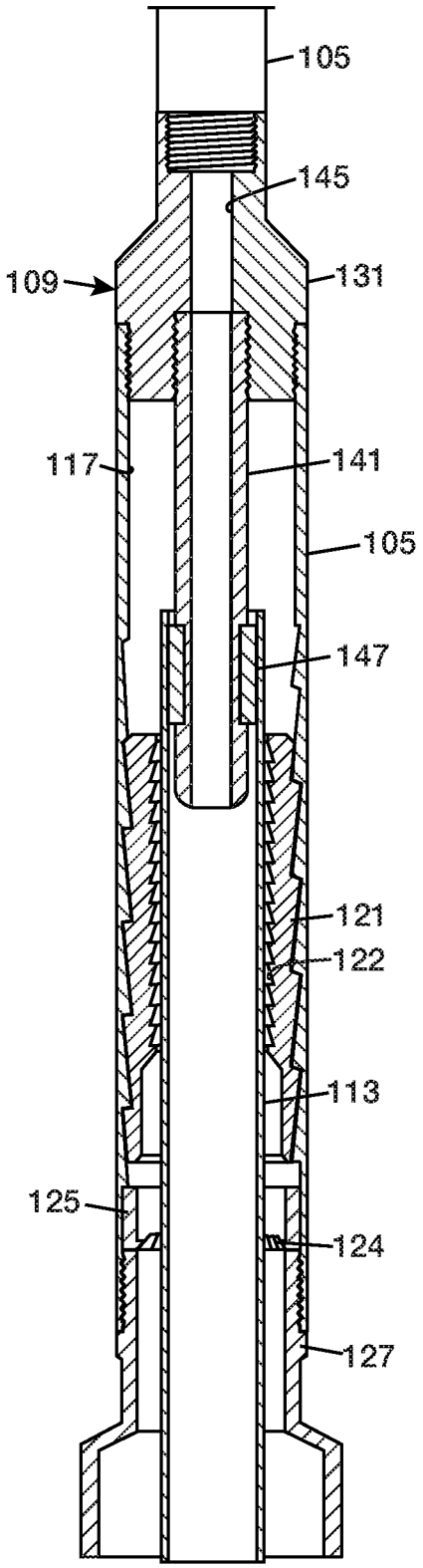
FIG. 5 shows a stinger of an overshot apparatus inserted into a fish.
Figure 6:
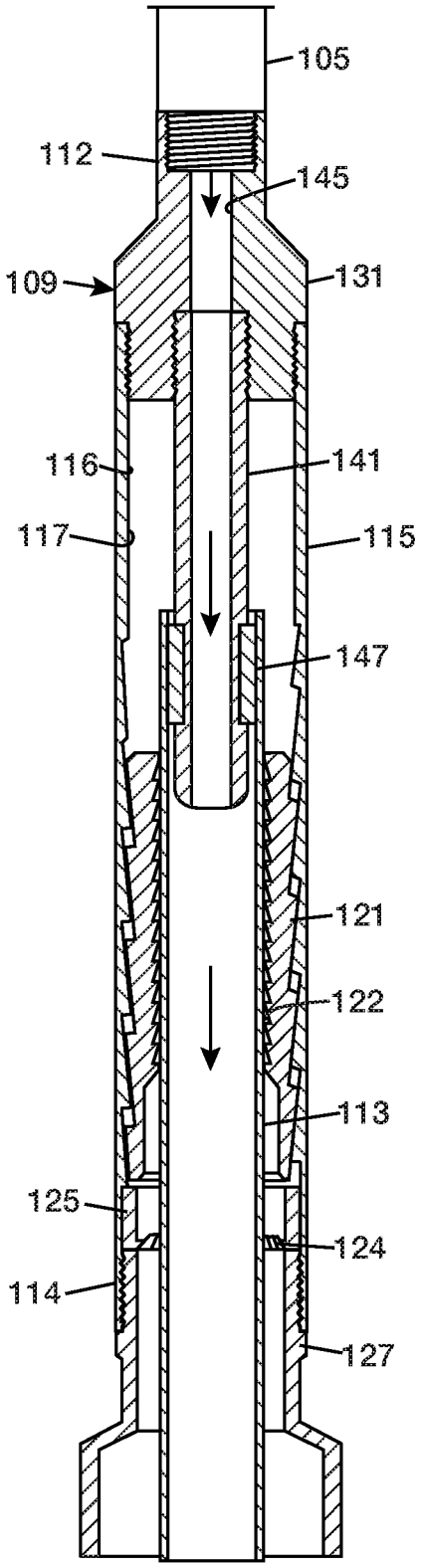
FIG. 6 shows a grapple of an overshot apparatus gripping an outside diameter of a fish.

For illustration purposes, a fish 113 is shown inside wellbore 107. A method of retrieving fish 113 includes dressing bowl 115 of overshot apparatus 109 with the appropriate size of grapple control, grapple, and external packing element on the stinger. The method includes attaching overshot apparatus 109 to work string 105 and running work string 105 into wellbore 107. As overshot apparatus 109 gets close to fish 113, pump 103 may be started at a slow rate while slowly rotating work string 105 and overshot apparatus 106, e.g., at 10 to 20 rpm. Overshot apparatus 109 will continue to advance into wellbore 107 as work string 105 is rotated. Fluid provided to the conduit of work string 105 will flow into the conduit 145 (in FIG. 1) of the top sub and the conduit 143 (in FIG. 1) of the stinger and exit from the bottom end of overshot apparatus 109, washing away debris around fish 115. Eventually, guide 127 will be placed over the mouth of fish 113, as shown in FIG. 3. As overshot apparatus 109 is further lowered, rotation of overshot apparatus 109 may allow mill teeth 124 (in FIG. 1) at the end of grapple control 125 (in FIG. 1) to clear out debris around the outer diameter of fish 113. As overshot apparatus 109 is further lowered, fish 113 will advance into grapple 121, as shown in FIG. 4. Further lowering of overshot apparatus 109 will cause stinger 141 to slide into fish 113, as shown in FIG. 5. Once stinger 141 is inside fish 113, external packing element 147 on stinger 141 will engage the inner diameter of fish 113, creating a seal between the fish and the stinger. A pull force may be applied to overshot apparatus 109 to move bowl 115 relative to grapple 121, resulting in the diameter of grapple 121 becoming smaller and causing wickers 122 on grapple 121 to firmly grip the outer diameter of fish 113, as shown in FIG. 6. In this manner, grapple 121 engages the outer diameter of fish 113 while external packing element 147 on stinger 141 engages the inner diameter of fish 113.

Figure 7:
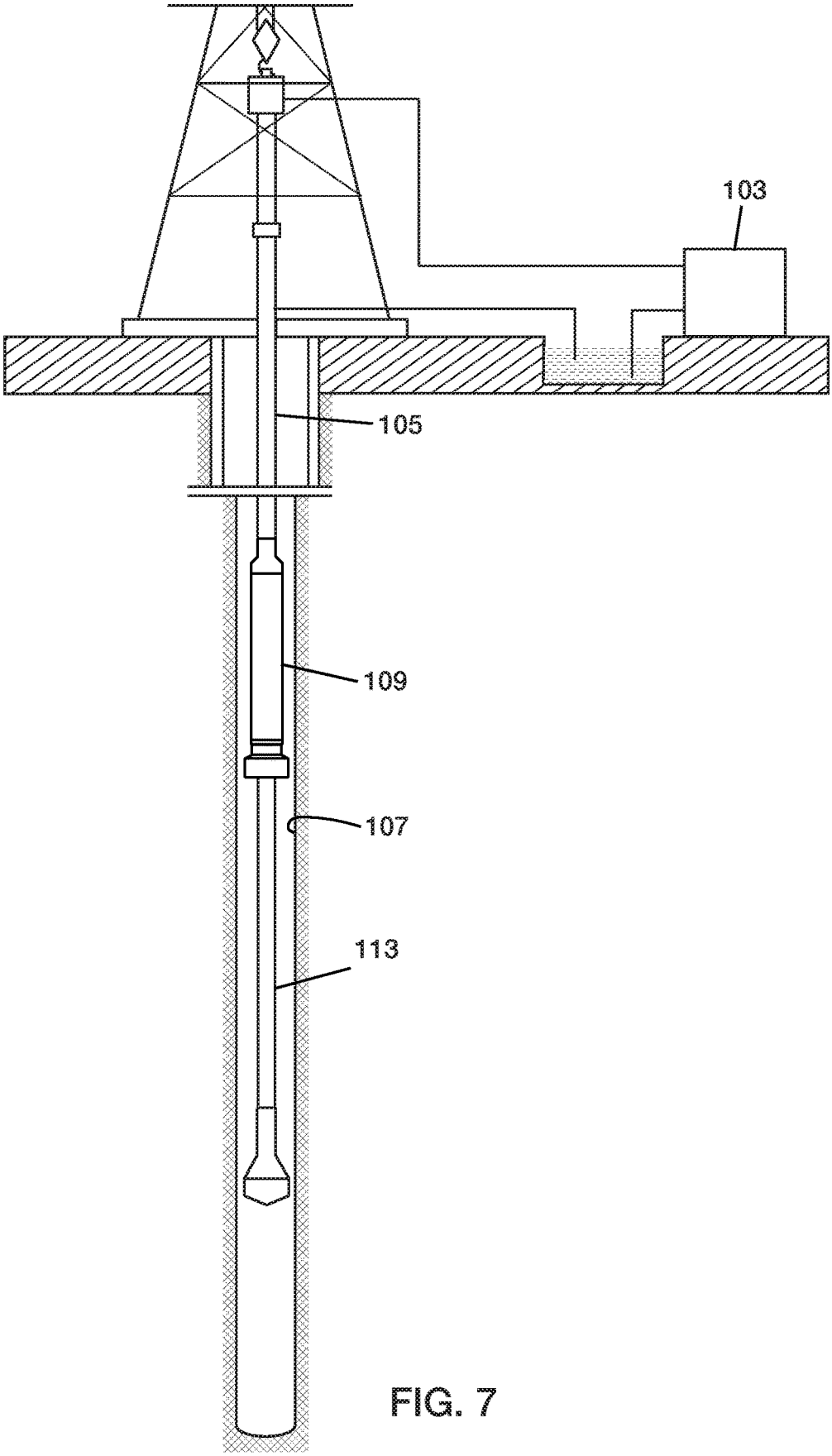
FIG. 7 shows the system of FIG. 2 as a work string is pulled out of the wellbore with the overshot apparatus and fish.

In one implementation, when the overshot apparatus 109 is near fish 113 but not yet engaged with fish 113, pump 103 is started at a slow rate to pump fluid into work string 105 while slowly rotating work string 105. This slow pumping of fluid into work string 105 and slow rotation of work string 105 continue until an increase in pressure at the pump and an increase in rotational torque are observed at the surface, which would signify that grapple control 125 is swallowing fish 113. At this point, pump 103 may be switched off to stop flow of fluid into work string 105. Work string 103 can be kept slack until grapple 121 has caught fish 113 and stinger 141 has entered into fish 113 (as shown in FIG. 5). When stinger 141 enters fish 113, the stand pipe pressure at the surface should register a higher pressure due to the seal formed between stinger 141 and fish 113 by external packing element 147. The stand pipe pressure gauge at the surface measures the pressure drop due to friction from the pump across the work string 105 all the way back. Therefore, the higher pressure at the stand pipe pressure can be used as an indicator that the seal has been formed. At this point, work string 103 may be tensioned to cause grapple 121 to firmly grip fish 113. After detecting that the seal has been formed between the stinger and fish 113, pump 103 can be started slowly to establish circulation to the bottom of fish 113. The pumping rate may be in a range from 1 barrel per minute to 5 barrels per minute. Hydraulic markers can be observed to confirm that circulation has been established prior to carrying out other procedures, such as operating jars in the work string. FIG. 7 shows that the fish has been freed and is being pulled out of the wellbore with the overshot apparatus.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. An apparatus comprising:

a tubular housing having an inner surface defining a bore;

a grapple disposed within the bore and movably engaged with a profile on the inner surface of the tubular housing, the grapple having a central opening to receive a fish and operable to grip an outer diameter of the fish;

an adapter attached to an upper end of the tubular housing, the adapter having a first conduit;

a stinger disposed within the bore, attached to the adapter, having a second conduit fluidly connected to the first conduit, and having a stinger end positioned to be inserted into the fish received in the central opening of the grapple, wherein the tubular housing is configured to rotate relative to the grapple to reduce a diameter of the grapple causing wickers on the grapple to grip the fish when the stringer is inserted into the fish and a pull force is applied to the fish using the stinger; and a packing element positioned on an external surface of the stinger offset from the stinger end creating a cushion between the stinger end and the packing element, the packing element configured to engage an inner diameter of the fish when the stinger is inserted into the fish and the fish is received within the central opening of the grapple.

2. The apparatus of claim 1, wherein the adapter includes a first connection for the stinger and a second connection for a work string, and wherein the first conduit extends between the first connection and the second connection.

3. The apparatus of claim 2, wherein the first and second connections include box threads of opposite hands.

4. The apparatus of claim 1, further comprising a grapple control disposed within the bore and engaged with the inner surface of the tubular housing, the grapple control having a key inserted into a slot in the grapple, the grapple control having a central opening for passage of the fish to the central opening of the grapple.

5. The apparatus of claim 4, wherein the grapple control comprises mill teeth positioned to mill around the fish as the fish passes through the central opening of the grapple control.

6. The apparatus of claim 4, further comprising a guide attached to a lower end of the tubular housing, the guide having a central opening for passage of the fish into the central openings of the grapple control and grapple.

7. The apparatus of claim 1, wherein the packing element is replaceably mounted on the external surface of the stinger.

8. The apparatus of claim 1, wherein the packing element is disposed in a slot formed on the external surface of the stinger.

9. A system comprising:

an overshot apparatus comprising:

a tubular housing having an inner surface defining a bore;

a grapple disposed within the bore and movably engaged with a profile on the inner surface of the tubular housing, the grapple having a central opening to receive a fish and operable to grip an outer diameter of the fish;

an adapter attached to an upper end of the tubular housing, the adapter having a first conduit;

a stinger disposed within the bore, attached to the adapter, having a second conduit fluidly connected to the first conduit, and having a stinger end positioned to be inserted into the fish received in the central opening of the grapple, wherein the tubular housing is configured to rotate relative to the grapple to reduce a diameter of the grapple causing wickers on the grapple to grip the fish when the stringer is inserted into the fish and a pull force is applied to the fish using the stinger; and a packing element positioned on an external surface of the stinger offset from the stinger end creating a cushion between the stinger end and the packing element, the packing element configured to engage an inner diameter of the fish when the stinger is inserted into the fish and the fish is received within the central opening of the grapple; and a work string coupled to the adapter, the work string having a third conduit fluidly connected to the first conduit in the adapter.

10. The system of claim 9, wherein the overshot apparatus is movably disposed in a wellbore on an end of the work string.

11. The system of claim 10, further comprising a pump arranged to supply a fluid into the work string.

12. The system of claim 11, further comprising a mechanism to rotate the work string.

13. The system of claim 9, wherein the adapter includes a first connection that engages the stinger and a second connection that engages the work string, and wherein the first conduit extends between the first connection and the second connection.

14. The system of claim 13, wherein the first and second connections include box threads of opposite hands.

15. The system of claim 9, wherein the overshot apparatus further comprises a grapple control disposed within the bore and engaged with the inner surface of the tubular housing, the grapple control having a key inserted into a slot in the grapple, the grapple control having a central opening for passage of the fish into the central opening of the grapple.

16. The system of claim 15, wherein the grapple control comprises mill teeth positioned to mill around the fish as the fish passes through the central opening of the grapple control.

17. The system of claim 15, wherein the overshot apparatus further comprises a guide attached to a lower end of the tubular housing, the guide having a central opening for passage of the fish to the central openings of the grapple control and grapple.

18. A method comprising:

running an overshot apparatus into a wellbore on an end of a work string;

receiving a fish within a central opening of a grapple of the overshot apparatus;

inserting a stinger, having a stinger end, of the overshot apparatus into the fish while the fish is received within the central opening of the grapple;

engaging a packing element carried on an outer diameter of the stinger with an inner diameter of the fish to form a seal between the stinger and the fish, wherein the packing element is positioned on an external surface of the stinger offset from the stinger end creating a cushion between the stinger end and the packing element; and applying a pull force on the fish using the overshot apparatus to rotate the tubular housing relative to the grapple to reduce a diameter of the grapple causing wickers on the grapple to grip an outer diameter the fish.

19. The method of claim 18, further comprising pumping a fluid into the work string to establish circulation of the fluid to a bottom of the fish.

20. The method of claim 19, further comprising detecting the seal between the stinger and the fish prior to pumping the fluid into the work string to establish circulation of the fluid to the bottom of the fish.

* * * * *